US005263207A

United States Patent [19]

Gilbert

[11] Patent Number: 5,263,207

[45] Date of Patent: Nov. 23, 1993

[54] HANDICAPPED BATHER'S LIFT FOR HOME BATHROOM

[76] Inventor: Lloyd H. Gilbert, 4241 Colt Dr., Lake Havasu City, Ariz. 86403

[21] Appl. No.: 903,459

[22] Filed: Jun. 24, 1992

[51] Int. Cl.[5] ..... A47K 3/12

[52] U.S. Cl. ..... 4/562.1; 4/564.1

[58] Field of Search ..... 4/560.1-566.1; 5/83.1; 414/921

[56] References Cited

U.S. PATENT DOCUMENTS

| | | | |
|---|---|---|---|
| 2,187,283 | 1/1940 | Scheutz | 4/561.1 X |
| 2,792,951 | 5/1957 | White | 414/921 |
| 3,381,317 | 5/1968 | Daniels et al. | 4/563.1 |
| 3,413,662 | 12/1968 | Stayton | 4/562.1 |
| 3,918,108 | 11/1975 | Feyerherm | 4/563.1 |
| 4,206,523 | 6/1980 | James | 4/562.1 |
| 4,905,327 | 3/1990 | Boublil | 4/562.1 |
| 4,928,330 | 5/1990 | Moore | 4/562.1 |
| 5,129,112 | 7/1992 | Schaffer | 4/560.1 |

FOREIGN PATENT DOCUMENTS

| | | | |
|---|---|---|---|
| 2007570 | 4/1978 | Fed. Rep. of Germany | 4/562.1 |
| 2206007 | 1/1980 | Fed. Rep. of Germany | 4/561.1 |

*Primary Examiner*—Henry J. Recla
*Assistant Examiner*—Robert M. Fetsuga
*Attorney, Agent, or Firm*—James F. Duffy

[57] ABSTRACT

An economical simple to install bathing lift for use by handicapped persons in the home bathroom includes a hydraulic jack which has a seat rotationally coupled to the jack shaft and is slidingly coupled to a vertical slide shaft. Preferred is a hydraulic jack of the type utilized for mounting and removing campers from the beds of pickup trucks, denoted herein as R.V. jacks. A sub-assembly having a seat rotationally coupled to the cylinder of the R.V. jack and slide couplers welded to the cylinder is suggested for commercial availability. Floor and ceiling supports for the vertical slide shaft can be packaged with the sub-assembly. The slide shaft may be purchased at a local hardware supply.

3 Claims, 2 Drawing Sheets

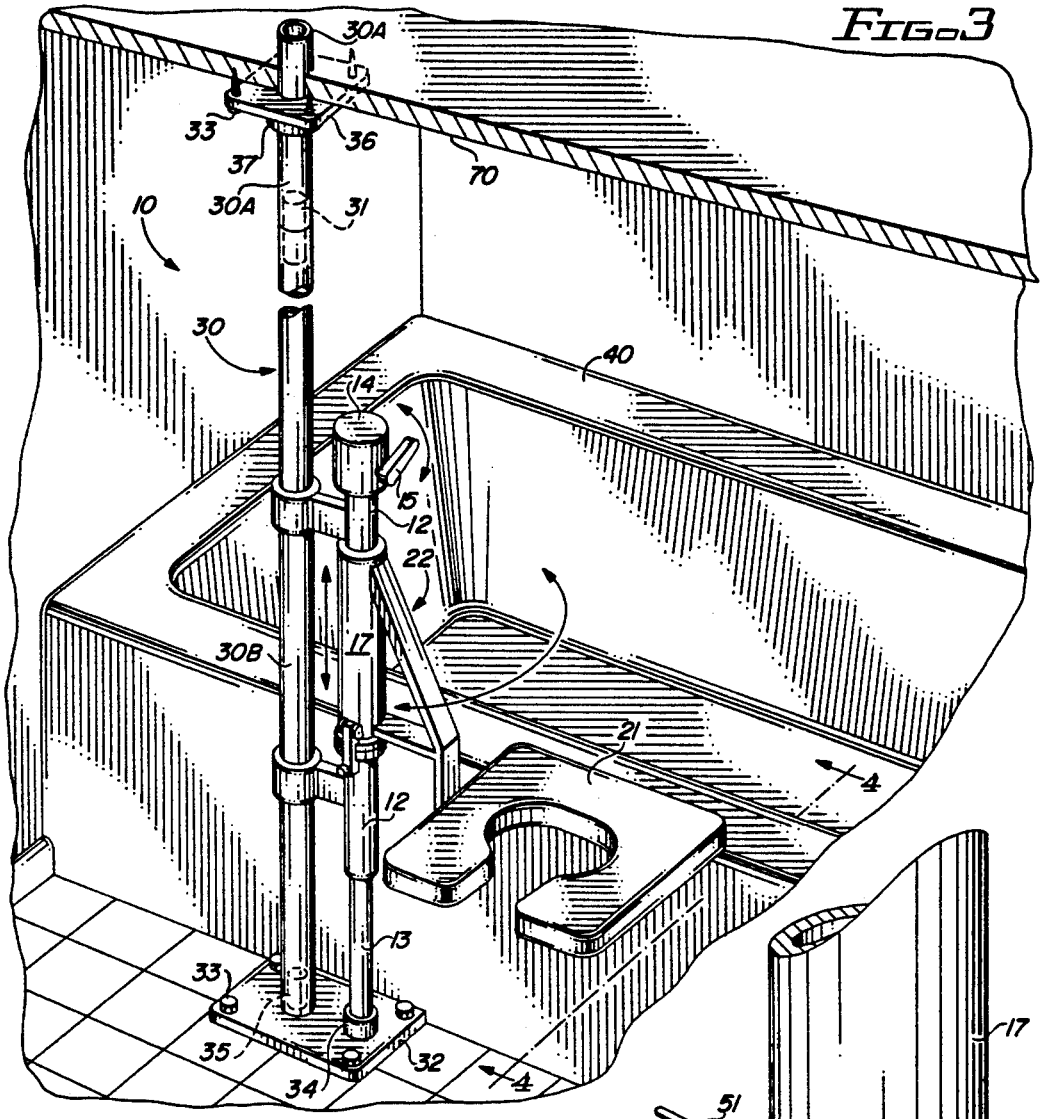
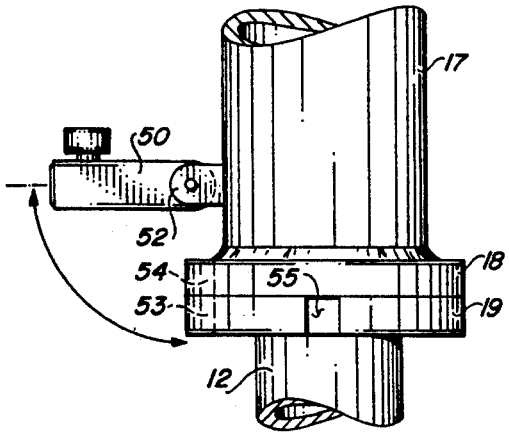
FIG. 6
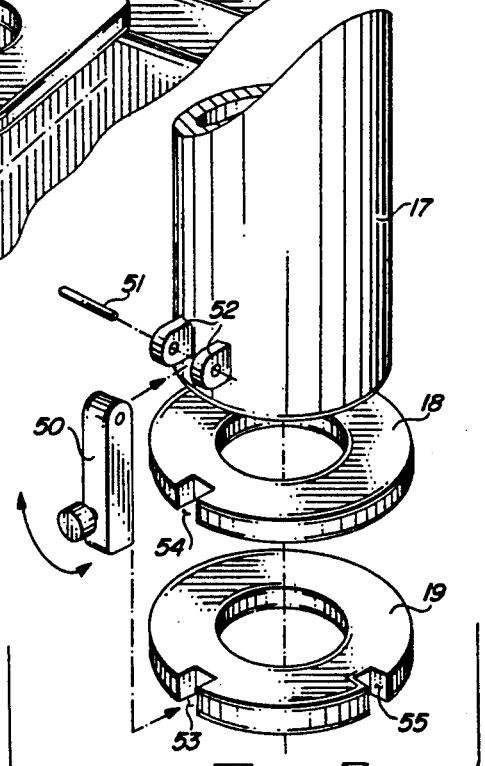
FIG. 5

HANDICAPPED BATHER'S LIFT FOR HOME BATHROOM

BACKGROUND

1. Technical Field of the Invention

The invention relates to lifts for use in a home bathroom to enable a handicapped person to enter the bathtub where the person may take a soaking bath.

2. Prior Background Art

Various devices have been presented in the prior art to enable a handicapped person to move from a seated position on a wheelchair to a seated position within a bathtub. All these devices are characterized by a vertical column along which a seat support travels up and down to raise and lower a person in the seat. The seat support also rotates about the vertical column to move the person from a position above the floor of the bathroom to a position above the floor of the tub. U.S. Pat. Nos. 4,905,327 to Boublil issued May 6, 1990, and 4,928,330, issued to Moore on May 29, 1990, are representative of such devices.

It is personal misfortune when a person becomes handicapped. Not only are his activities restricted, but more often than not the financial burden of providing for "ordinary" needs can become enormous. The simple act of soaking in a tub filled with warm water often becomes impossible to achieve. Bathrooms are renovated and shower stalls which accommodate a wheelchair are installed. Of those devices available to transfer a handicapped person into a bathtub, the costs are great and often the devices consume much of the available space and require professionals to install.

It is the intention of the present invention to provide a relatively inexpensive lift which can be readily installed by a handyman.

It is a further intention of the invention that a simple, prefabricated sub-assembly will be made commercially available, such that a person in possession of the sub-assembly need buy only some standard materials to complete an installation.

SUMMARY DESCRIPTION OF THE INVENTION

The invention is disclosed and claimed as an improvement in a bath lift for aiding a handicapped person to enter and exit a bathtub. The prior art bath lift has a vertical column along which a seat and its support travel up and down to raise and lower a person in the seat. The seat and support are rotatable to move a person between a position above the bathtub and a position above the floor adjacent the bathtub. The improvement itself comprises a hydraulic pump having a hydraulic piston cylinder housing a hydraulically actuated piston and piston rod.

There are first coupling means rotatingly coupling the seat and its support to the hydraulic cylinder for rotation about the cylinder.

Second coupling means slidingly couple the hydraulic cylinder to the vertical column and slide along the column in response to actuation of the piston rod by the pump.

In use, a first actuation of the pump will raise the seat above the level of the bathtub. Rotation of the first coupling means positions the seat over the bathtub. A second, releasing, actuation of the pump lowers the seat into the bathtub, the sequence of actions being reversible.

The improvement includes rotation locking means coupling the first coupling means and the hydraulic cylinder for selectedly locking the seat and its support in selected rotated positions about the cylinder.

The hydraulic pump, cylinder and piston rod comprise a recreational vehicle (R.V.) jack conventionally used to raise and lower a pick-up camper from and to the bed of a pick-up truck.

The invention is also claimed as a bath lift for aiding a handicapped person to enter and exit a bathtub, the bath lift being produced by the process of obtaining a recreational vehicle (R.V.) jack having a hydraulic pump, a piston cylinder and a piston rod;

attaching a first slide coupling sleeve to the piston cylinder;

positioning a rotational coupling sleeve on the piston cylinder;

attaching a second slide coupling sleeve to the piston cylinder;

affixing a seat and seat support to the rotational coupling sleeve;

obtaining a pipe, slidingly insertable within the first and the second slide coupling sleeves;

inserting the pipe slidingly within the first and the second coupling sleeves;

affixing the pipe in a generally vertical disposition adjacent a bathtub;

whereby actuating the R.V. jack raises the seat and its support, rotating the rotational coupling sleeve rotates the seat and its support about the piston cylinder, and releasing the R.V. jack lowers the seat and its support, the raising and lowering being guided by the first and the second slide coupling sleeves sliding along the vertically disposed pipe.

BRIEF DESCRIPTION OF THE DRAWINGS

FIG. 3 shows the bathing lift installed in a bathroom adjacent a bathtub.

FIG. 5 is an exploded view of the items employed to positively lock the bathing lift in either one of two desired rotary positions.

FIG. 6 is an elevational view of the assembled items of FIG. 5.

DETAILS OF BEST MODE FOR CARRYING OUT THE INVENTION

Figure 1:
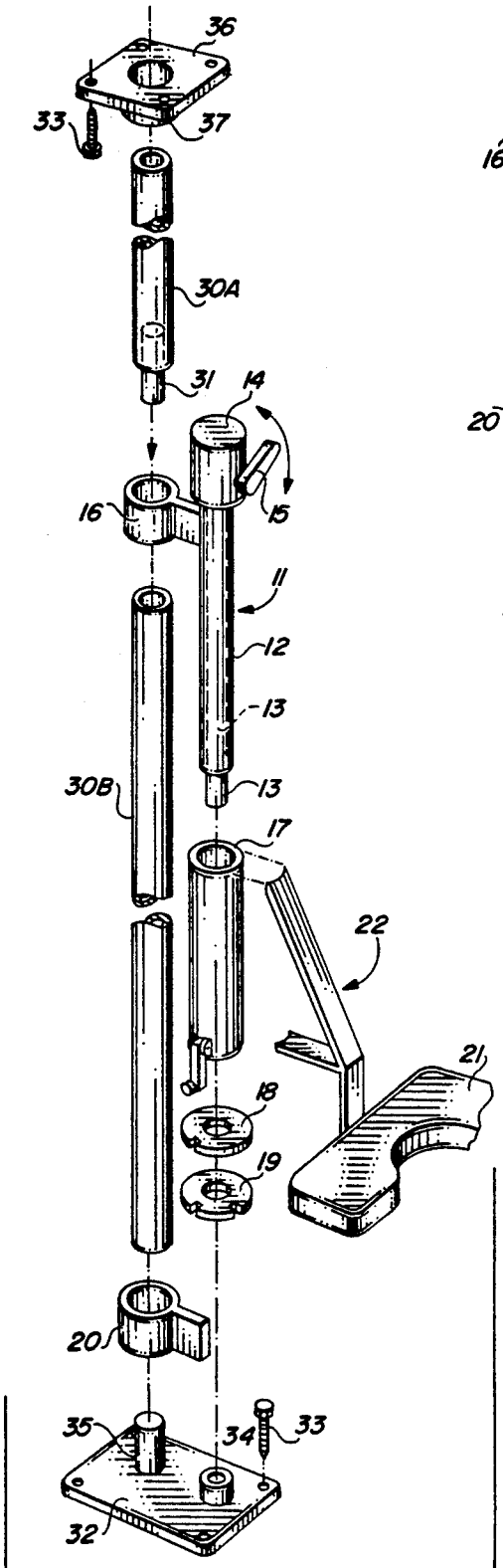
FIG. 1 is an exploded assembly view of the bathing lift.

For purposes of promoting an understanding of the principles of the invention, reference will now be made to the embodiments illustrated in the drawings and specific language will be used to describe same. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

FIG. 1 is an exploded assembly view of the bathing lift 10. Motive force is provided by manually actuated hydraulic jack 11. The jack depicted is the type commercially available for use with Recreational Vehicles (R.V.). Jack 11 comprises a cylinder 12 which houses a piston rod 13. By way of example, and not of limitation, it is typical for cylinder 12 to be approximately three feet long and for piston rod 13 and to be extendible a distance greater than two feet from cylinder 12. A hydraulic pump 14 is provided at the upper end of cylinder 12. Actuation of pump handle 15 causes hydraulic fluid from the pump to extend piston 13 from cylinder 11 in a manner well known to those skilled in the art.

In the assembly drawing, a first slide coupler 16 has been welded to cylinder 12 just below hydraulic pump 14. A rotary coupler 17, in the form of a sleeve, will slide upwards over cylinder 12. A contact bearing 18, in the form of a washer, is welded to the bottom of rotary coupler 17 A similar bearing 19 slides upward over cylinder 12 and is welded to cylinder 12 below rotary coupler 17 and bearing 18. Bearing 18 will make bearing contact on bearing 19 in the completed assembly. A second slide coupler 20, in general alignment with first slide coupler 16, is welded to cylinder 12 below bearing 19.

Rotary coupler 17 is now captive in position on cylinder 12 but is free to rotate about cylinder 12. See FIG. 2.

A seat 21 is affixed to a seat support frame 22. Seat support frame is welded to rotary coupler 17. In practice, this welding of seat support frame 22 to rotary coupler 17 may be best achieved before coupler 17 is positioned on cylinder 12.

Figure 2:
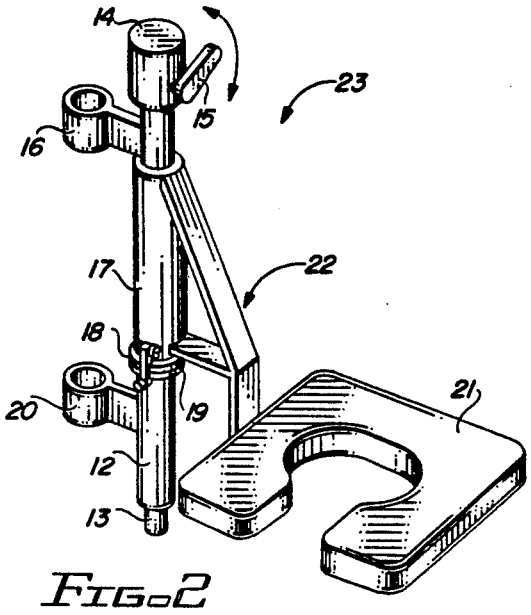
FIG. 2 is a sub-assembly of an R.V. jack with a seat rotatingly coupled to the jack's cylinder.

The assembly, to this point, produces the sub-assembly 23 of items 11 through 22 shown in FIG. 2. Because most home owners will lack the facilities and capabilities for welding, it is anticipated that sub-assembly 23 will be made commercially available for use by home owners for installation in the home by a handyman.

Means must now be provided to guide the bathing lift 10 along a vertical path. To this end a slide shaft 30 is provided. Slide shaft 30 is indicated in the assembly drawing of FIG. 1 as two pipe sections 30A and 30B. A coupler 31 is provided for joining the two sections together. In practice a single length of pipe or the like may be employed. Multiple sections, for example 30A and 30B, may be utilized if slide shaft 30 is packaged with sub-assembly 23. Having slide shaft 30 supplied as an assembly would ease shipping problems. However, as earlier noted, a single length of pipe or the like will serve as the slide shaft and can be readily installed between floor and ceiling in a home's bathroom.

The portions 30A and 30B of slide shaft 30 are assembled and slidingly coupled to sub-assembly 23 using slide couplers 16 and 20. A floor support base 32 is affixed to the bathroom floor utilizing screw fasteners 33. Floor support base 32 is preferably affixed to the floor adjacent the bathtub in the manner indicated in FIGS. 3 and 4.

A cylindrical support 34 on base 32 accepts the end of piston 13 of sub-assembly 23. Support post 35 on base 32 is encompassed within the hollow interior of section 30B of slide shaft 30.

Before erecting slide shaft 30 to its vertical position, the upper end of slide shaft 30 is inserted into and through cylindrical support 37 on ceiling support header 36. Thereafter, slide shaft 30 may be positioned vertically, ceiling support header moved upwards along the shaft until it makes contact with ceiling 70 (FIG. 3) and fastened in place utilizing screw fasteners 33. The completed assembly is shown in FIG. 3.

In the completed assembly of FIG. 3, pump lever handle 15 has been actuated to cause hydraulic pump 14 to extend piston rod 13 from cylinder 12. In so extending, sub-assembly 23 has been caused to rise, traveling along slide support 30 and raising seat 21 from approximate floor level to a height higher than the upper surface of bathtub 40. A handicapped person may transfer to seat 21 from his wheelchair or other walking aid. Seat 21 is then rotated, with the co-operation of rotary sleeve 17, about cylinder 12 so as to position seat 21 and it occupant above the floor of tub 40.

Figure 4:
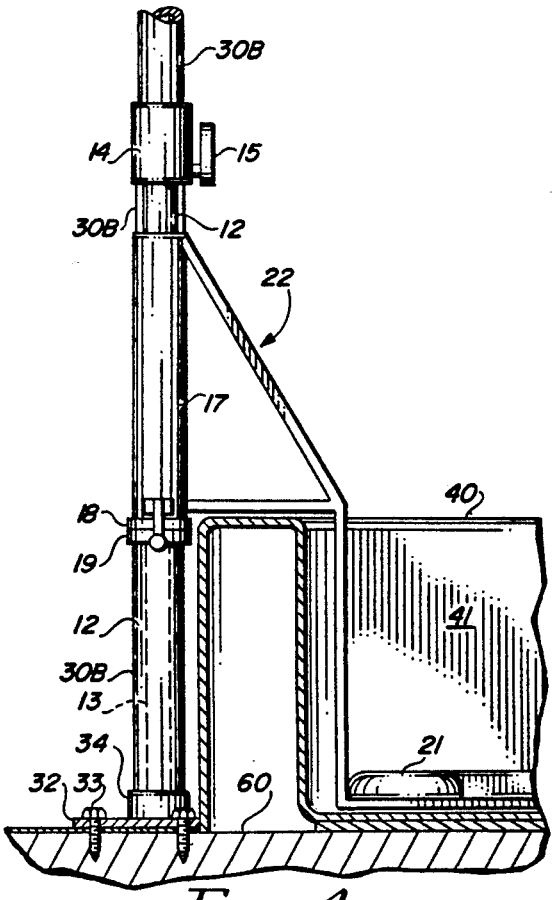
FIG. 4 is a partial sectional view along line 4—4 of FIG. 3 showing the bathing lift seat rotated and lowered with respect to its position in FIG. 3.

With the person seated in seat 21 and positioned above the floor of tub 40, hydraulic pressure is released from pump 14; and seat 21 is lowered, with its occupant, into the interior 41 of tub 40. The resulting disposition is shown in FIG. 4 wherein tub 40 is shown in partial cross-section, that cross-section including a section of floor 60 and showing the manner in which floor support base 32 is secured to the floor.

Note that seat 21 extends down almost to the bottom of tub 40. Thus, a person seated on seat 21 may immerse themselves in warm bath water and experience what would otherwise be a luxury to them in their handicapped condition.

Upon actuation of pump lever handle 15 once more, seat 21 will raise upward from and above tub 40 to be then rotated back to the position shown in FIG. 3. At this point the handicapped person may dismount from seat 21 and regain his wheelchair or walking aid. Because assembly 23 with its seat 21 is free to rotate about cylinder 12, it is highly desirable that rotation be inhibited at one or two positions so that no rotation of the seat takes place while the handicapped person is mounting or dismounting from seat 21, or while seat 21 is being lowered into or raised from tub 40. To this end a simple locking device is made available.

The locking device is illustrated in FIGS. 5 and 6 and is merely suggestive of one form of locking arrangement which may be utilized. FIG. 5 is an exploded assembly showing a portion of rotary coupler sleeve 17, bearings 18 and 19, and lock bar 50. Recall from the discussion of the assembly of parts in FIG. 1 that bearing 18 is welded to rotary coupler 17 whereas bearing 19 is welded to piston cylinder 12. Thus, bearing 18 rotates with respect to bearing 19 when rotary coupler sleeve 17 is rotating about cylinder 12.

As seen is FIG. 5 a notch 54 has been placed in the peripheral edge of bearing 18. In a first rotary position of sub-assembly 23, for example, that shown is FIG. 3, another notch 53 appears in bearing 19. Notches 54 and 53 are in alignment when seat 21 is in the position shown in FIG. 3. At this point, bar 50 is inserted into both notch 53 and 54 to inhibit the rotation of bearing 18 with respect to bearing 19.

When bar 50 is removed from its engagement with notches 53 and 54, rotary coupler sleeve 17 is again free to rotate about cylinder 12. There is a third notch 55. Notch 55 is the second notch is bearing 19. Notch 55 is approximately 90 degrees removed from the position of notch 53. Thus, with bar 50 removed, rotary coupler and bearing 18 may be rotated counter clockwise, with respect to FIGS. 5 and 3 to cause notch 54 in bearing 18 to be in alignment with notch 55 in bearing 19. Once more bar 50 may be moved, this time into position within notches 54 and 55, to prevent relative rotary motion between bearings 18 and 19. In this instance, seat 21 will have been rotated so as to position a person within tub 40. See FIG. 4.

To simplify the placement of bar 50 within the aligned notches in bearings 18 and 19, bar 50 is pivotally mounted to rotary coupler sleeve 17 using pivot support blocks 52 and pivot pin 51. The completed assembly is shown in the side elevational view of FIG. 6.

In practice, bar 50 may be spring loaded so to be nominally pressed into engagement with the notches in bearings 18 and 19. Thus, by lifting bar 50 to disengage it from a notch in bearing 19, rotary coupler sleeve 1 7, with the attached seat 21, may be rotated about the cylinder 12 and, when the bar aligns with the next adjacent notch in bearing 19, its spring loading will drive it into locking position within that notch.

What has been disclosed is an economical, simple to install bathing lift for use by handicapped persons in the home bathroom. A hydraulic jack having a seat rotationally coupled to the jack shaft is slidingly coupled to a vertical slide shaft. Preferred is a hydraulic jack of the type utilized for mounting and removing campers from the beds of pickup trucks, denoted herein as an R.V. jack. A sub-assembly having a seat rotationally coupled to the cylinder of the R.V. jack and slide couplers welded to the cylinder is suggested for commercial availability. Floor and ceiling supports for the vertical slide shaft can be packaged with the sub#assembly. The slide shaft may be purchased at a local hardware supply.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, that which is claimed is:

1. In a bath lift for aiding a handicapped person to enter and exit a bathtub, the bath lift having a vertical column adjacent which a seat and seat support travel up and down to raise and lower a person in the seat, the seat and support being rotatable to move a person between a position above the bathtub and a position above the floor adjacent the bathtub, the improvement comprising:

a hydraulic pump having a hydraulic piston cylinder housing a hydraulically actuated piston and piston rod, said hydraulic cylinder having a longitudinal axis;

first coupling means rotatably coupling said seat and its support to said hydraulic cylinder for rotation about said longitudinal axis of said cylinder, and for longitudinal movement with said cylinder; and second coupling means slidingly coupled said hydraulic cylinder to said vertical column to slide along said column in response to actuation of said piston rod by said pump, first actuation of said pump extending said rod to raise said cylinder, with said seat, upward along said column, and second, releasing actuation of said pump retracting said rod to lower said cylinder and said seat downward along said column;

whereby a first actuation of said pump will raise said cylinder with said seat longitudinally along said column and above the level of said bathtub, rotation of said first coupling means positions said seat from a first position aside said bathtub to a second position over said bathtub, and a second, releasing, actuation of said pump lowers said hydraulic cylinder along said vertical column to lower said seat into said bathtub, the sequence of actions being reversible.

2. The improvement of claim 1 further comprising rotation locking means coupling said first coupling means and said hydraulic cylinder for selectedly locking said seat and its support in selected rotated positions about said cylinder.

3. The improvement of claim 1 wherein said hydraulic pump, cylinder and piston rod comprise a recreational vehicle (R.V.) jack conventionally used to raise and lower a pick-up camper from and to the bed of a pick-up truck.

* * * * *